US006077017A

United States Patent [19]

Durant

[11] Patent Number: 6,077,017

[45] Date of Patent: Jun. 20, 2000

[54] VEHICLE HANDLING SYSTEM

[75] Inventor: Jacob Lodewyk Durant, Brakpan, South Africa

[73] Assignee: Park Plus, Inc., Long Island City, N.Y.

[21] Appl. No.: 09/092,701

[22] Filed: Jun. 5, 1998

[30] Foreign Application Priority Data

Jun. 6, 1997 [ZA] South Africa ..... 97/5021

[51] Int. Cl.[7] ..... E04H 6/06

[52] U.S. Cl. ..... 414/254; 414/261; 414/282

[58] Field of Search ..... 414/253, 254, 414/255, 227, 256, 261, 263, 264, 277, 279, 282, 281, 284

[56] References Cited

U.S. PATENT DOCUMENTS

| | | | |
|---|---|---|---|
| 3,896,955 | 7/1975 | Collins et al. | 414/254 |
| 4,465,417 | 8/1984 | Baumann et al. . | |
| 4,950,117 | 8/1990 | Go | 414/254 |
| 4,971,506 | 11/1990 | Givati . | |
| 4,998,856 | 3/1991 | LaBarre . | |
| 5,037,263 | 8/1991 | Yamashita . | |
| 5,116,182 | 5/1992 | Lin . | |
| 5,333,987 | 8/1994 | Takaoka . | |
| 5,374,150 | 12/1994 | Becker et al. | 414/254 |

FOREIGN PATENT DOCUMENTS

| | | | |
|---|---|---|---|
| 0 314 837 | of 1989 | European Pat. Off. . | |
| 0 394 130 | 10/1990 | European Pat. Off. . | |
| 0 478 070 | of 1992 | European Pat. Off. . | |
| 0 504 750 | of 1992 | European Pat. Off. . | |
| 0 573 858 | of 1993 | European Pat. Off. . | |
| 2 607 175 A1 | of 1988 | France . | |
| 41 30 141 A1 | of 1993 | Germany . | |
| 94 05 565 U1 | of 1995 | Germany . | |
| 1-219263 | 9/1989 | Japan | 414/254 |
| 3-228974 | 10/1991 | Japan | 414/254 |
| 4-24375 | 1/1992 | Japan | 414/254 |

*Primary Examiner*—Frank E. Werner
*Attorney, Agent, or Firm*—Anthony J. Casella; Gerald E. Hespos; Michael J. Porco

[57] ABSTRACT

A vehicle handling system is provided for an automated parking garage. The system includes a loading platform dimensioned to support a vehicle, the loading platform including gratings each formed by a plurality of spaced-apart, parallel bars. The system also includes a carriage also formed with a grating having a plurality of spaced-apart, parallel bars, wherein the gratings of the loading platform and the carriage being sized and configured to allow the bars of the carriage to pass between the bars of the loading platform. The system also includes a lifting mechanism for lifting a vehicle away from the loading platform. The lifting mechanism may be a stacker crane assembly allowing both vertical and horizontal movement of the carriage or a robot trolley and lift assembly. The system may also include a turntable for changing the orientation of the vehicle within the garage.

12 Claims, 8 Drawing Sheets

VEHICLE HANDLING SYSTEM

BACKGROUND OF THE INVENTION

1. Field of the Invention

This invention relates to an article handling system, more particularly a vehicle handling system for an automated parking garage.

2. Description of the Prior Art

Conventionally, a parking garage has a number of levels with ramps providing vehicular access between the various levels. These ramps take up a significant amount of space in the parking garage which reduces the area available for parking bays.

Automated parking garages have been developed which dispense with the need for ramps as lifts are used to raise and lower vehicles between the various levels of the garage. Conventionally, each vehicle is placed on a pallet on its arrival at the garage, with the vehicle being moved and stored on this pallet while housed in the garage.

Two significant problems exist with the use of pallets in an automated parking garage. Firstly, sufficient pallets must be provided to correspond to the number of vehicles which can be housed within the garage and secondly, the pallets take up space within the parking garage.

SUMMARY OF THE INVENTION

According to a first aspect of the invention there is provided an article handling system, the article handling system comprising a loading platform comprising a plurality of spaced apart support members adapted to support an article; a carriage comprising a plurality of spaced apart lifting members which are spaced complementally to the spacing between the support members of the platform, thereby being adapted to pass upwardly between the support members of the platform and to support the article whilst it is lifted away from the platform; and lifting means operable to raise and lower the carriage relative to the platform. Preferably, the article handling system is a vehicle handling system for an automated parking garage.

According to a second aspect of the invention there is provided an automated parking garage comprising a building having a plurality of vehicle storage stations; a loading surface adapted to receive a vehicle entering the garage and to support the vehicle on its wheels; and a carriage adapted to pass upwardly through the loading surface and to support the vehicle whilst it is lifted away from the loading surface and into a selected vehicle storage station. Preferably, both the loading surface and the carriage have gratings comprising a plurality of parallel bars, the gratings of the loading structure and the carriage being sized and configured to allow the bars of the carriage to pass between the bars of the loading structure. Typically, the garage includes a lifting mechanism for lifting a vehicle away from the loading surface towards the storage stations. The lifting mechanism may be a stacker crane assembly allowing both vertical and horizontal movement of the carriage or a robot trolley and lift assembly. The garage may include a turntable for changing the orientation of the vehicle within the garage.

According to a third aspect of the invention there is provided a method of manoeuvring a vehicle into a selected storage station of an automated parking garage, the method comprising the steps of receiving a vehicle onto a loading surface; supporting the wheels of the vehicle on the loading surface; transferring the vehicle from the loading surface to a carriage by passing the carriage through the loading surface; and moving the vehicle, whilst supported on carriage, into the selected storage station. Preferably, the method also includes the step of transferring the vehicle from the carriage to a storage structure provided in the storage station.

Various embodiments of the invention are described in detail in the following passages of the specification which refer to the accompanying drawings. The drawings, however, are merely illustrative of how the invention might be put into effect, so that the specific form and arrangement of the features shown is not to be understood as limiting the invention.

BRIEF DESCRIPTION OF THE DRAWINGS

FIG. 8 is a partial front view of the automated parking garage with detailed sections of a vehicle stored within a station in the garage and a vehicle being raised on the stacker crane within the garage.

DETAILED DESCRIPTION OF THE INVENTION

Figure 2:
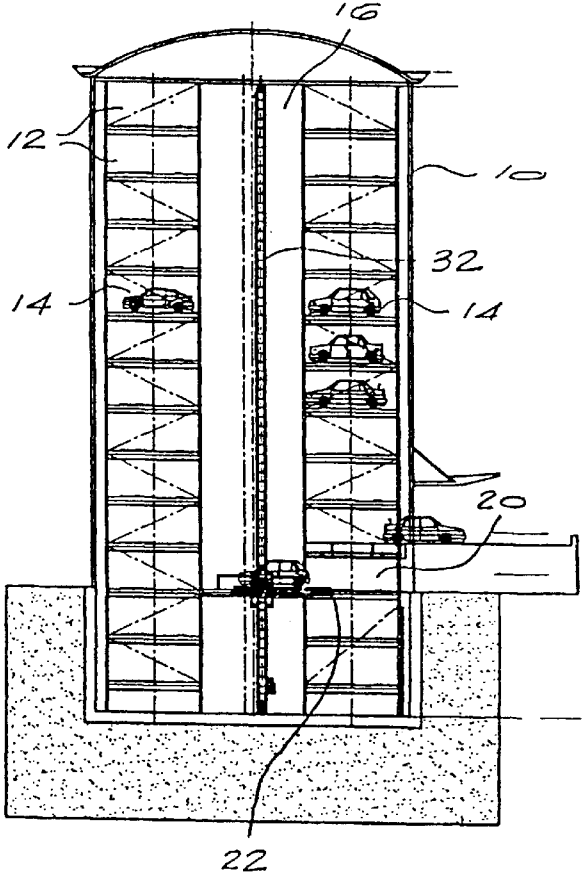
FIG. 2 is a cross-sectional side elevation of the parking garage depicted in FIG. 1.
Figure 1:
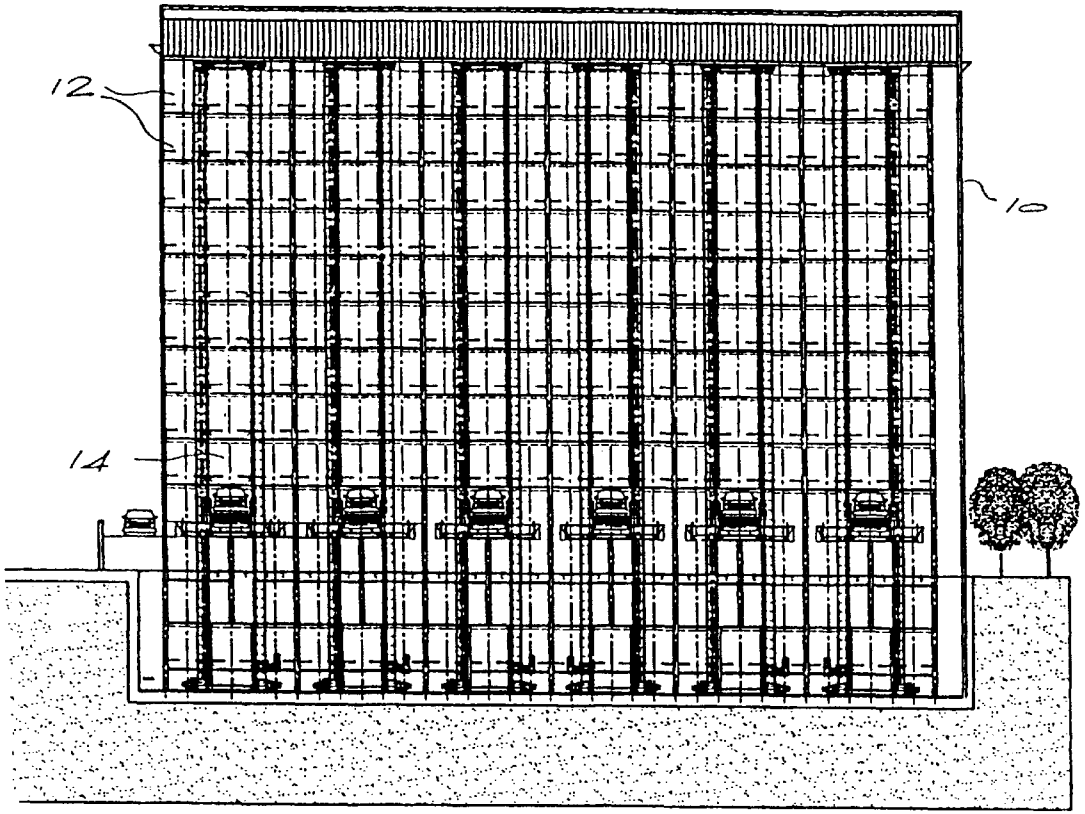
FIG. 1 is a cross-sectional front elevation of an automated parking garage according to the invention.

The automated parking garage 10 depicted in FIGS. 1 and 2 consists of a building having thirteen levels, with each level 12 having a number of bays 14 for the storing of vehicles. A central shaft 16 is provided which allows the vehicles to be raised, lowered and moved horizontally on a stacker crane mechanism within the structure.

Figure 3:
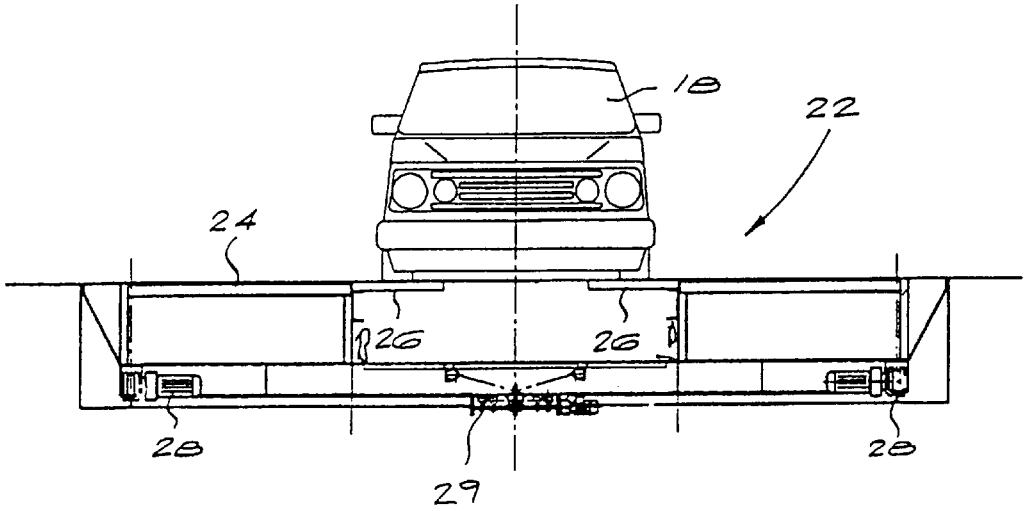
FIG. 3 is a side view of a vehicle handling apparatus of the invention.
Figure 4:
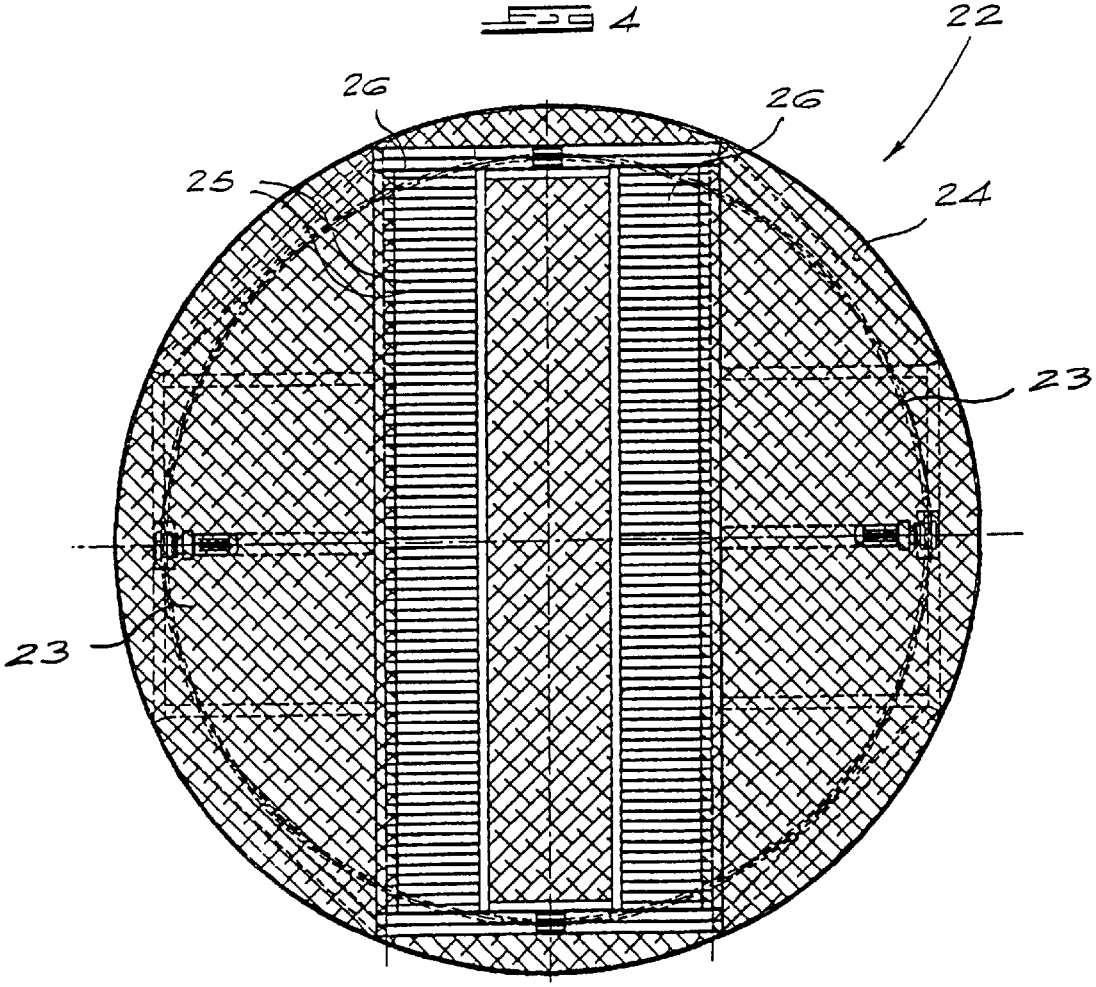
FIG. 4 is a plan view of the apparatus depicted in FIG. 3.

On arrival of a vehicle 18 at the garage 10 the vehicle is driven through the entrance 20 and onto the turntable 22 depicted in FIGS. 3 and 4. An L.E.D. display adjacent to the entrance to the garage indicates the number of vacant bays within the garage. This display is updated as a vehicle enters or leaves the garage. A convenient way of doing this is by means of an magnetic loop triggered as a vehicle passes through it.

The turntable 22 has a false floor 23 which can be raised and lowered and a pair of gratings 26 extending transversely across the turntable 22. Each of the gratings is made up of a series of cantilevered parallel bars 25 spaced apart from one another and supported at opposed outer sides of the gratings. The pair of gratings 26 are spaced apart so that they can receive the wheels of most passenger vehicles. A drive and bearing mechanism 28 is provided beneath the turntable which allows the turntable, with a vehicle supported on the gratings 26, to be rotated.

The vehicle is driven onto the turntable 22 with its wheels positioned on the gratings 26. At this stage the size of the vehicle is checked to ensure that it can be accommodated within the garage and all passengers are requested to vacate the vehicle. Oversized vehicles which cannot be accommodated within the garage are at this stage excluded from entry into the garage. An infrared sensor may be used to ensure that no passengers inadvertently remain within the vehicle. The false floor is then lowered ready for the vehicle to be lifted off the turntable and housed in a storage bay of the garage.

Figure 5:
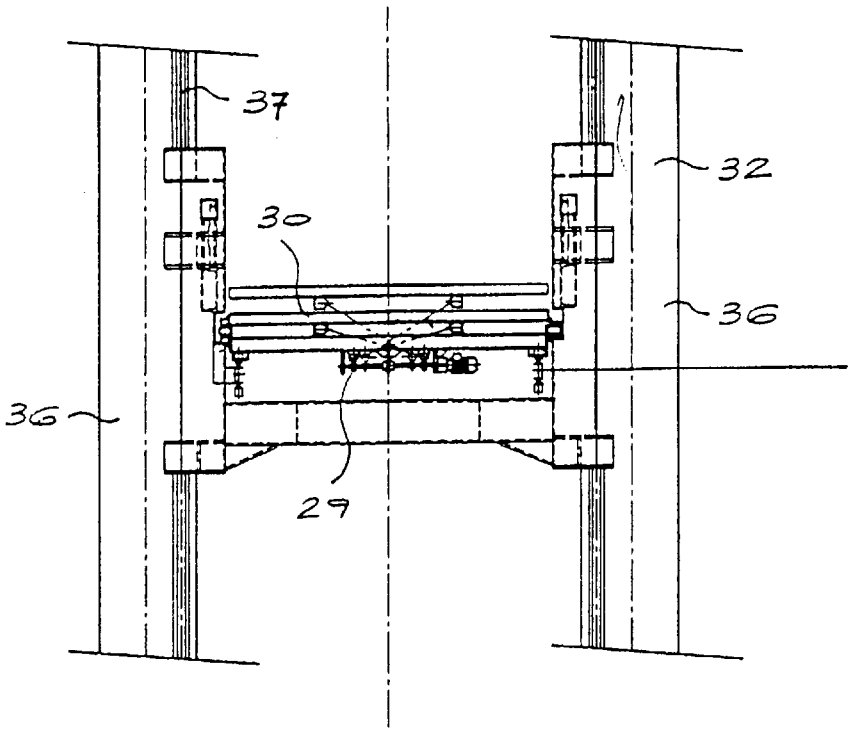
FIG. 5 is a side view of a carriage of a stacker crane associated with the apparatus of FIGS. 3 and 4.
Figure 6:
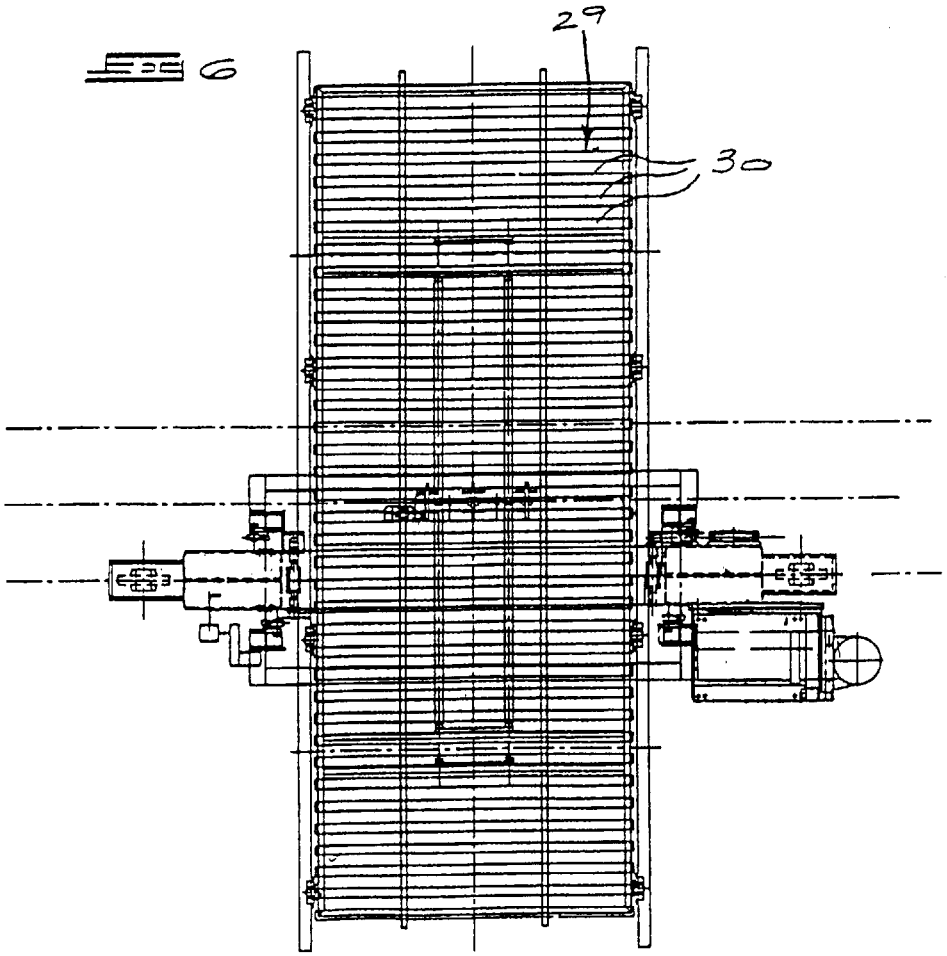
FIG. 6 is a plan view of the carriage depicted in FIG. 5.
Figure 9:
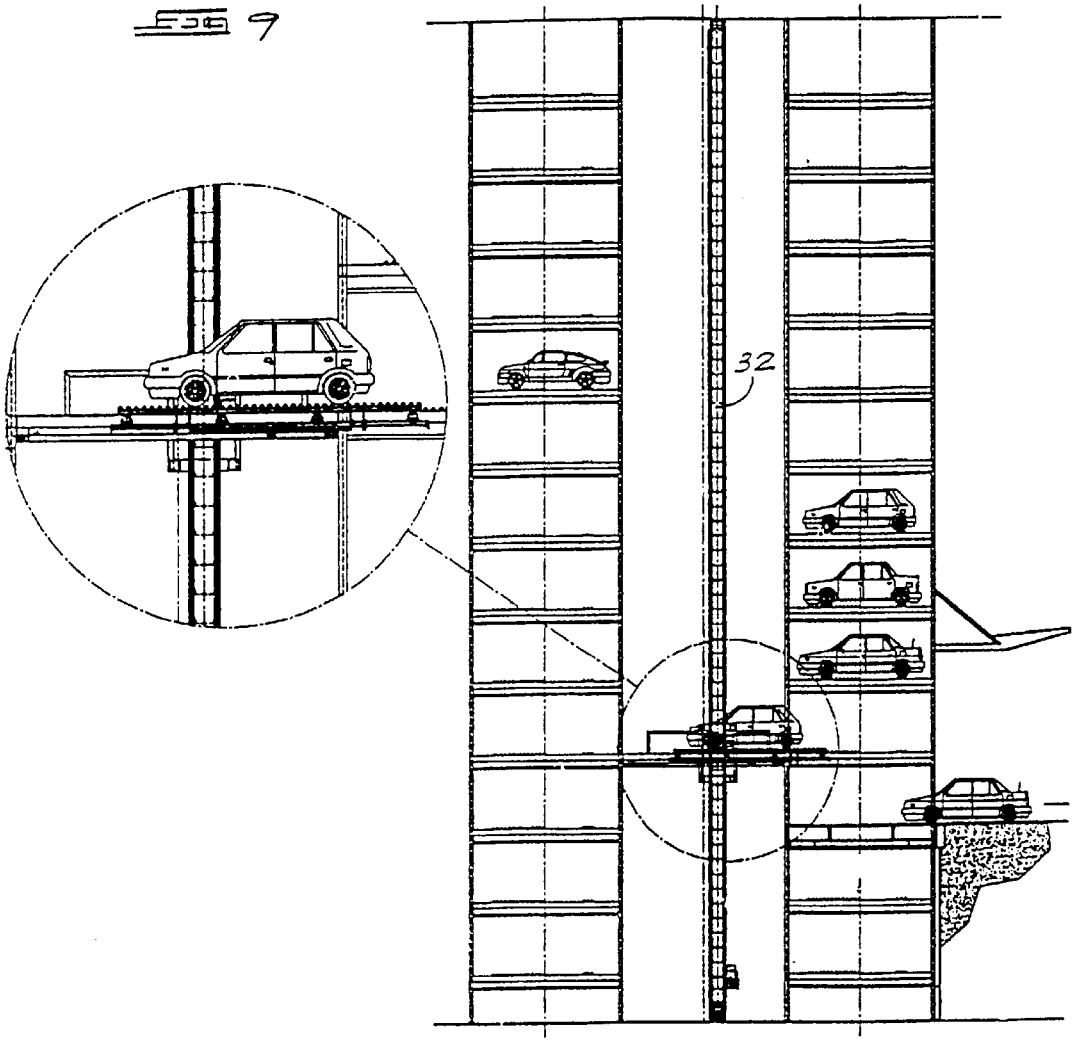
FIG. 9 is a side view of the section of the automated parking garage depicted in FIG. 7.

FIGS. 5 and 6 depict the carriage 29 which is used to manoeuvre the vehicle around the garage 10. The carriage 29 is formed of a rigid welded frame which includes a grating having a series of bars 30 arranged in parallel alignment with one another. The sizing of the bars and the spacing between them is arranged to allow the bars 30 to pass in an interdigitated fashion between the bars 25 of the turntable gratings 26. In this way a vehicle which is supported on its wheels on the gratings 26 of the turntable 22 may be lifted away from the turntable by passing the grating of the carriage 29 through the gratings of the turntable 22 thereby transferring the vehicle from the turntable 22 to the carriage 29. Once on the carriage 29 the vehicle is ready to be transported to its selected storage bay.

The carriage 29 is mounted on a stacker crane 32 for raising and lowering the carriage 29, with or without a vehicle supported on it, within the garage. The stacker crane 32 has a gantry which includes a pair of masts 36 on which the carriage 29 can travel vertically. The masts 36 are of robust construction, being formed of rigid box-section steel girder.

Figure 7:
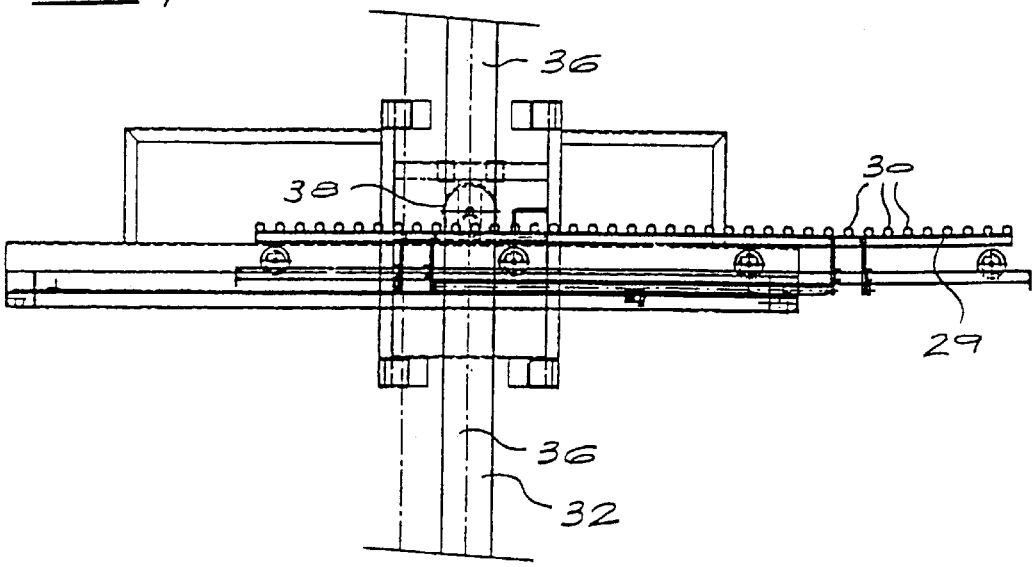
FIG. 7 is a side view of the carriage depicted in FIGS. 5 and 6 in its extended condition.
Figure 9:
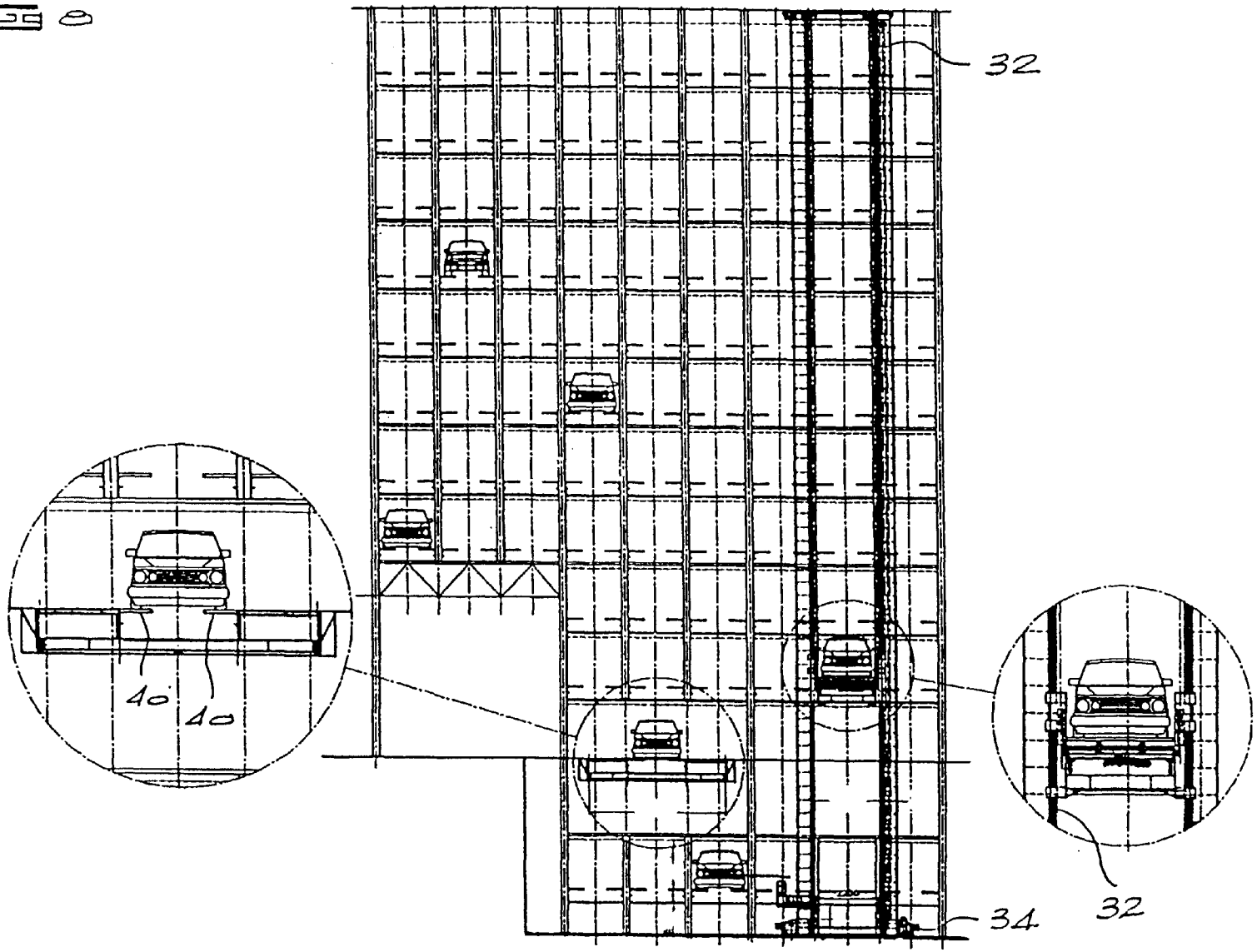

The stacker crane 32 has a hoist drive 34 which provides the lifting force necessary to lift the carriage, and any vehicle it may be supporting, into horizontal alignment with the storage bay in which the vehicle is to be stored. The carriage 29 is suspended from hoist ropes 37 which are reeved around the drum of the hoist drive 34 and which are guided in their longitudinal motion up and down the masts 36 by guide runners provided on the masts. The longitudinal motion of the carriage up and down the masts is further guided by two sets of guide rollers 38 (FIG. 7) provided on the carriage.

The hoist drive 34 in the illustrated embodiment of the invention consists of an AC motor and an enclosed reduction gearbox of the hollow hub type, fitted with a rope drum. The hoisting rope is reeved onto machined grooves provided on the rope drum, with the carriage 29 being suspended from an opposite end of the hoisting rope. The rope anchorage between the hoisting rope and the carriage includes a spring and safety device which cuts the electrical supply to the stacker crane in the event of breakage or slackening of the rope. As a further precaution safety wedges are deployed by the stacker crane to prevent the carriage 29 from falling should the rope break or slacken.

In addition to the lifting and lowering motion of the carriage within the gantry, the stacker crane 32 is provided with a horizontal movement mechanism. This allows the carriage 29 to be moved horizontally along an aisle of a particular level of the garage and into a position adjacent to a particular parking bay in which a vehicle is to be stored.

The carriage is also provided with a third degree of freedom in its movement, namely an extending and retracting movement. This extending and retracting movement, which is best illustrated by reference to FIG. 7 in which the carriage is illustrated in its extended position, allows the carriage to deposit a vehicle in, or remove a vehicle from, a bay once the carriage has been positioned in the required horizontal alignment with the bay. The extending and retracting motion may be in either direction away from the gantry allowing the carriage to be moved into bays on opposite sides of the gantry. The extending and retracting movement is also used to raise a vehicle off the turntable.

Each of the bays 14 in the garage is provided with a pair of gratings 40 similar to those provided on the turntable. These gratings in the bays allow a vehicle supported on the carriage to be transferred from the carriage to the gratings of the bay by passing the carriage downwardly through the grating. This procedure is reversed when a vehicle is being collected from a bay by the carriage.

When a vehicle is ready to be collected from the turntable the carriage is called to collect the vehicle. The carriage is arranged in the required horizontal alignment with the turntable whereafter the lateral movement mechanism extends the carriage under the gratings of the turntable. The carriage is then passed through the gratings of the turntable, thereby lifting the vehicle away from the turntable. The carriage is then retracted into the gantry of the stacker crane where it can be lifted to position the vehicle in the selected parking bay. Once aligned within the bay the lateral movement mechanism extends the carriage into the bay and lowers the vehicle onto the gratings of the bay. The carriage is then retracted into the gantry of the stacker crane for further use.

In order to retrieve a vehicle stored within the garage the carriage is sent to the bay in which the vehicle is stored. At the bay the carriage lifts the vehicle off the bay gratings on which it is supported and retracts it into the stacker crane which lowers it down the shaft and back onto the turntable following the reverse steps to those which were followed when the vehicle was stored in the bay.

Once the vehicle is on the turntable, the turntable is rotated through 180 degrees thereby facing the vehicle forwards out of the entrance through which the vehicle initially entered the garage. It will be appreciated that the turntable may be dispensed with if the design of the garage allows the vehicle to be driven out of the garage in a forwards direction without the orientation of the vehicle having to be rotated from its orientation on the stacker crane.

The position of the carriage within the garage is monitored at all times by means of sensors, with linear encoders being positioned along the length of the gantry of the stacker crane and along the aisles between the bays on each level. Positioning flags are placed at each storage bay to define the exact stopping position of the crane. In addition, at each end of the aisle on each level a series of control flags are arranged to act as deceleration checks to ensure that the crane slows down at the correct rate towards the end of the aisle.

Many different types of safety features are built into the operation of the garage so as to prevent damage to vehicles housed within the garage. One such safety feature is the inclusion of vehicle size and centre position control cells which stop the operation of the stacker crane in the event of an abnormal condition occurring during vehicle handling. Similarly, "location occupied" cells indicate the presence of a vehicle within a particular bay which prevents a vehicle being loaded into a bay which is already occupied.

It is envisaged that the entire automated garage may be automated to avoid the necessity of manual control over the allocation of available bays and the operation of the lifting and storing equipment in the garage.

According to a second embodiment of the invention a robot trolley and vertical lift assembly replace the stacker crane mechanism described in the previous embodiment. The robot trolley is used to transport the carriage horizontally along the aisles of the garage. The carriage and robot trolley system is depicted in FIG. 10.

Figure 10:
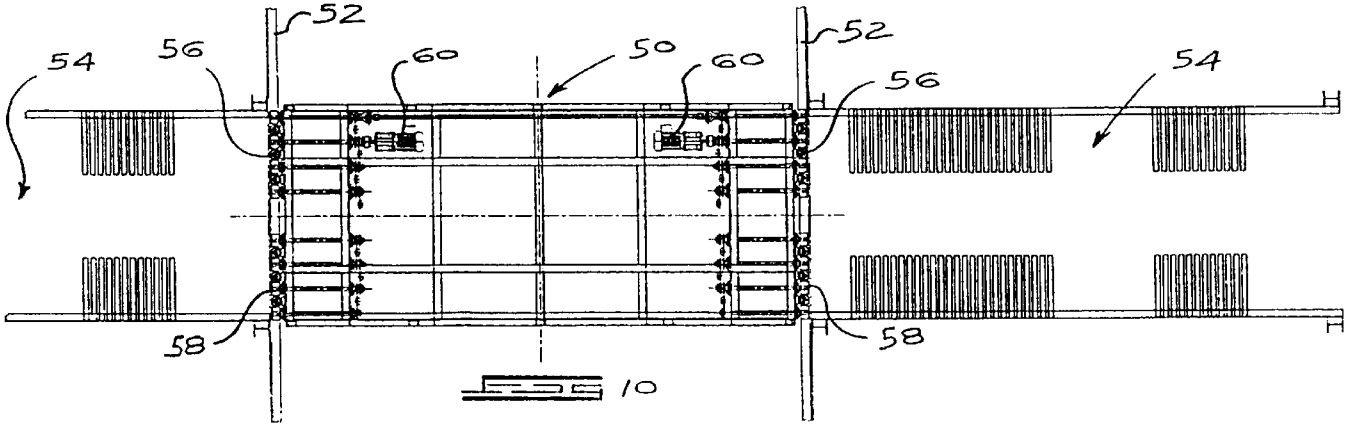
FIG. 10 is a plan view of a carriage and robot trolley system according to a second embodiment of the invention.

Referring to FIG. 10, the robot trolley 50 travels onto angle iron rails between the vehicle parking bays 54 located on opposite sides of the garage. The trolley is powered by a set of three phase bus bars 56 on one side of the trolley and a set of brushes 58 on the opposite side of the trolley for communications between the trolley and the central control system of the garage.

The trolley carries a transponder system which reads static tags mounted on each storage bay in order to determine the position of the trolley within the garage structure. The trolley sends an update of its position as it travels through the rack structure to the central control system of the garage.

When the trolley arrives at a selected storage bay, hydraulic shot-pins are inserted into the rack structure to ensure accurate alignment of the carriage with the rack structure.

The robot trolley travels on sixteen polyurethane covered wheels, all of which are driven and guided between the rack structure by eight side guide rollers. Two drive motors 60, of 2.2 Kw each, drive the trolley at a maximum speed of 60 meters per minute.

Two photo cells, one on each side of the trolley, when activated, switch the trolley to a slow speed mode, whilst another two sensors stop the drive when activated. The drive motors, hydraulic power pack for the shot-pins and the electrical control system are all incorporated into the underside of the robot trolley.

All movements of the trolley are controlled by an on-board PLC, a communications link with the PLC being used to action a deposit or retrieval operation of the carriage into a storage bay and to instruct the robot trolley to travel to a selected position adjacent to a storage bay. The trolley in turn instructs the central control system of the garage with its latest position as well as fault information. The trolley position within the storage rack is identified by a transponder system which reads tags position on the storage bays.

Two photo cells are mounted on opposite ends of the carriage to check that the storage bay is empty before attempting to locate a vehicle into the storage bay. This prevents the possibility of double parking and damage to vehicles. The action of the carriage for transferring a vehicle from a carriage into a storage bay is illustrated by reference to FIGS. 11 and 12. Once the robot trolley is positioned adjacent to the selected storage bay the shot-pins are inserted into the storage rack as described.

Figure 11:
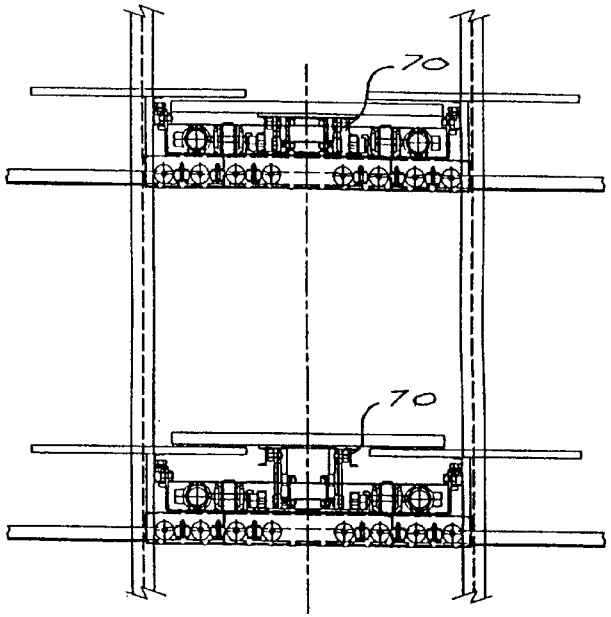
FIG. 11 is a front view of the carriage and robot trolley system depicted in FIG. 10 in a vertically extended and retracted condition.

Referring to FIG. 11 the carriage includes a scissor lift 70 for raising and lowering the grating of the carriage on which the vehicle is supported. FIG. 11 depicts the scissor lift in both its retracted and its extended conditions.

Figure 12:
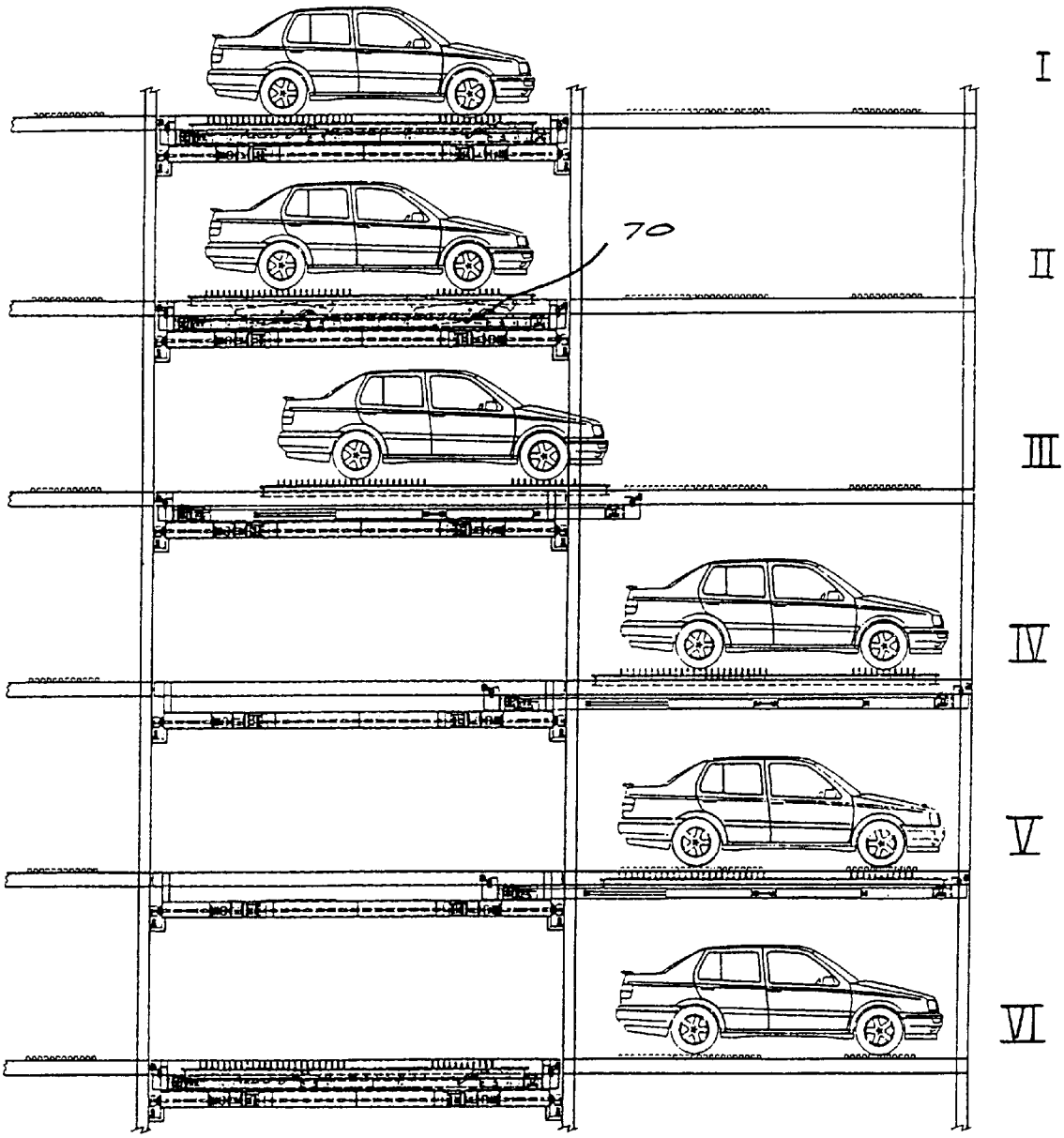
FIG. 12 is a side view of the carriage and robot trolley system depicted in FIGS. 10 and 11 depicting the various steps involved in depositing a vehicle onto the gratings of a storage bay.
Figure 13:
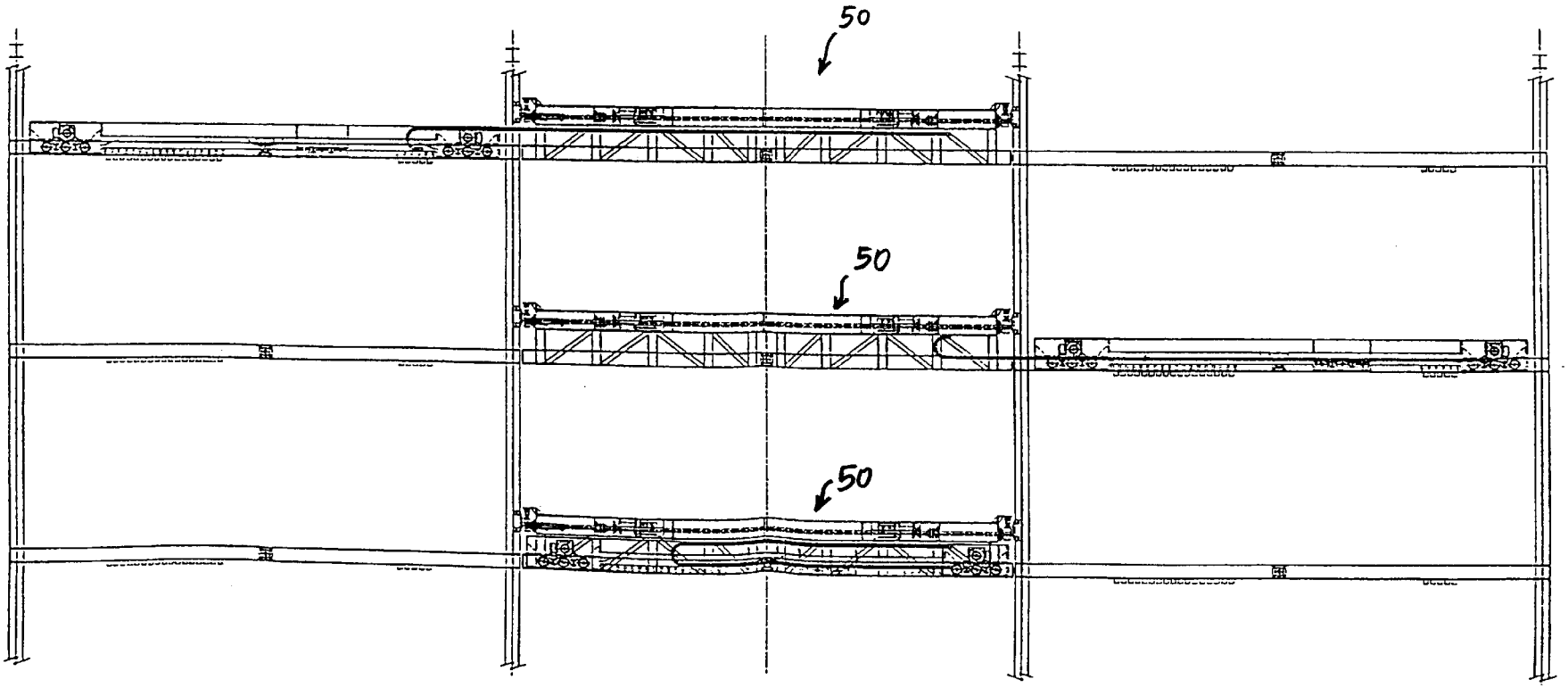
FIG. 13 is a side view of the carriage and robot trolley system depicted in the preceding drawings with the separate drawings depicting the carriage extended to the left and the right of an aisle respectively.

Referring to FIG. 12, once the robot trolley is positioned adjacent to the selected storage bay the scissor lift elevates the grating on which the vehicle is supported. If the vehicle is to be located in the storage bay on the right hand side of the aisle, the shot-pins on the right hand side of the robot trolley are retracted. The pinion drive is then energized to push the scissor lift assembly of the carriage towards and into the storage bay. Two sets of track runner bearings guide the carriage in the rack structure. This is depicted in step III of FIG. 12.

When the carriage reaches the extended position depicted in step IV of FIG. 12 the shot-pins are extended to align the carriage with the fixed grating structure of the storage bay. The scissor lift is retracted thereby lowering the vehicle onto the grating of the storage bay. This is depicted in step V of FIG. 12.

Once the scissor lift is in its retracted position the carriage is retracted from the storage bay. This step completes the process of depositing a vehicle into a storage bay.

According to this embodiment of the invention, on arrival of a vehicle at the garage it is driven through the entrance and onto the turntable as with the previously described embodiment. Thereafter, the shock pins are engaged and the arms of the scissor lift are extended below the grating of the turntable. Once in this fully extended position the carriage lifts the vehicle from the grating of the turntable up to a required height above the turntable. The robot trolley then retracts the arms of the scissor lift to within the confines of the aisle.

After confirmation of a successful loading of the vehicle by the on-board PLC of the robot trolley, the management system of the garage issues a delivery instruction consisting of the address of a specific storage bay within the garage and designating a lift and robot trolley for the procedure.

The main PLC of the garage management system then requests a lift for the required transfer. The robot trolley proceeds towards the specified lift, where on arrival the robot trolley follows the loading procedure and transfers the vehicle to the vehicle lift. The vehicle lift then proceeds towards the level at which the designated storage bay is situated once confirmation has been received that the robot trolley has completed the loading procedure and that the pick-up arms of the scissor lift have been retracted. Once height confirmation of the vehicle lift is received, the trolley starts with the unloading procedure. After loading has been completed the robot trolley proceeds towards the location of the designated storage bay.

On arrival of the robot trolley at the designated storage bay, the storage bay position is confirmed and off loading of the vehicle can proceed. The robot trolley extends the lifting arms of the scissor lift to the fully extended position and lowers the vehicle onto the grid within the storage bay. The lifting arms then retract within the confines of the aisle to complete the transfer. The main PLC informs the management system that the docking of the vehicle has been successful. The management system completes the transaction by indicating that the booked location is in fact the final destination for that vehicle and all relevant data associates with the vehicle is stored together with the final destination.

The vehicle retrieval process is essentially the reverse of that described above.

What is claimed is:

1. A vehicle handling system for an automated parking garage, said system comprising:

a building having a plurality of vehicle storage bays, wherein said storage bays are adjacent to a central shaft on all sides and are vertically aligned for a predetermined number of floors of said building;

a loading platform dimensioned to supportingly accommodate a vehicle, said loading platform including two spaced-apart gratings each formed by a plurality of spaced-apart, parallel bars, wherein said loading platform is disposed within said central shaft;

a carriage including a vehicle support grating formed by a plurality of spaced-apart, parallel support bars, said support bars being immovably fixed to said carriage, wherein said support bars are sized and configured to interdigitately pass through said bars of said loading platform, said carriage being capable of horizontal movement along an aisle of said bays and extending and retracting movement to deposit and remove a vehicle from said bays; and a lifting means coupled to a drive means for reversibly raising and lowering said carriage relative to said loading platform.

2. A system as in claim 1, wherein each said vehicle storage bay includes two spaced-apart storage gratings each formed by a plurality of spaced-apart, parallel storage bars, said storage bars being sized and configured to allow said support bars of said vehicle support grating to interdigitately pass therethrough.

3. A system as in claim 1, wherein said loading platform is rotatable.

4. A system as in claim 1, wherein said vehicle support grating defines a generally rectangular shape having a width and a length, each said support bar extending across the full width of said vehicle support grating.

5. A system as in claim 1, wherein said carriage is transported horizontally along said aisle of said bays by a robot trolley.

6. A system as in claim 1, wherein said robot trolley comprises shot-pins to align said carriage to said bay.

7. A vehicle handling system for an automated parking garage, said system comprising:

a building having a plurality of vehicle storage bays, wherein said storage bays are adjacent to a central shaft on all sides and are vertically aligned for a predetermined number of floors of said building;

a loading platform dimensioned to supportingly accommodate a vehicle, said loading platform including two spaced-apart gratings each formed by a plurality of spaced-apart, parallel bars, wherein said loading platform is disposed within said central shaft;

a carriage including a vehicle support grating formed by a plurality of spaced-apart, parallel support bars, said vehicle support grating defining a generally rectangular shape having a width and a length, each said support bar extending across the full width of said vehicle support grating, wherein said support bars are sized and configured to interdigitately pass through said bars of said loading platform, said carriage being capable of horizontal movement along an aisle of said bays and extending and retracting movement to deposit and remove a vehicle from said bays; and a lifting means coupled to a drive means for reversibly raising and lowering said carriage relative to said loading platform.

8. A system as in claim 7, wherein each said vehicle storage bay includes two spaced-apart storage gratings each formed by a plurality of spaced-apart, parallel storage bars, said storage bars being sized and configured to allow said support bars of said vehicle support grating to interdigitately pass therethrough.

9. A system as in claim 7, wherein said loading platform is rotatable.

10. A system as in claim 7, wherein said support bars are immovably fixed to said carriage.

11. A system as in claim 7, wherein said carriage is transported horizontally along said aisle of said bays by a robot trolley.

12. A system as in claim 7, wherein said robot trolley comprises shot-pins to align said carriage to said bay.

* * * * *